US010746380B1

(12) United States Patent
Mullen

(10) Patent No.: US 10,746,380 B1
(45) Date of Patent: Aug. 18, 2020

(54) LIGHT FIXTURE SURFACE MOUNT

(71) Applicant: Nate Mullen, Valley Center, CA (US)

(72) Inventor: Nate Mullen, Valley Center, CA (US)

( * ) Notice: Subject to any disclaimer, the term of this patent is extended or adjusted under 35 U.S.C. 154(b) by 0 days.

(21) Appl. No.: 16/559,458

(22) Filed: Sep. 3, 2019

(51) Int. Cl.
*F21V 21/02* (2006.01)
*F21S 8/00* (2006.01)

(52) U.S. Cl.
CPC ..... *F21V 21/02* (2013.01); *F21S 8/033* (2013.01)

(58) Field of Classification Search
CPC ... F21V 21/02; F21V 21/03; F21S 8/03; F21S 8/033; F21S 8/04; E04B 9/006; E04B 9/18
USPC ..... 248/342, 343, 344
See application file for complete search history.

(56) References Cited

U.S. PATENT DOCUMENTS 1,155,805 A * 10/1915 Guth ..... F21V 21/02 248/343
1,484,275 A * 2/1924 Riddle ..... F21V 21/02 174/62
1,484,747 A * 2/1924 Williamson ..... F21V 21/02 248/343
1,901,235 A * 3/1933 Glowacki ..... F21V 21/03 248/343
2017/0175793 A1* 6/2017 Leathlean ..... F16B 35/005

* cited by examiner

*Primary Examiner* — Alan B Cariaso
(74) *Attorney, Agent, or Firm* — Kelly & Kelley, LLP

(57) ABSTRACT

A low-profile surface mount for a light fixture. The surface mount consists of a base plate attached to a mounting surface, whether vertical, horizontal, or any angle in-between. The base plate has a raised central portion that defines an open area between the base plate and the mounting surface. The open area is positions over an electrical source, as a junction box or a hole in the mounting surface through which electrical wires are provided. A threaded opening in the raised central portion of the base plate provides access to the open area. A threaded mounting stem is attached to the threaded opening. A cover plate having a raised central portion generally matching that of the base plate is disposed over everything, this the mounting stem protruding through a non-threaded opening. A light fixture is attached to the mounting stem and abuts against the cover plate.

10 Claims, 10 Drawing Sheets

LIGHT FIXTURE SURFACE MOUNT

BACKGROUND OF THE INVENTION

The present invention is directed to a surface mount for a light fixture. More particularly, the inventive wall mount provides a low-profile surface mount for mounting a light fixture, while providing for greater concealment of electrical wires and permitting optional installment on surfaces of varying orientations.

Surface mounts for light fixtures are known in the art. However, such prior art surface mounts have notable drawbacks, including but not limited to, a single mounting orientation, a requirement that they be mounted on electrical junction boxes or similar, or exposed or otherwise visible electrical wires.

Accordingly, there is a need for a light fixture surface mount that more easily and reliably conceals electrical wires, provides installation options on other than electrical junction boxes, and provides options for installation on surfaces of any orientation. The present invention fulfills these needs and provides other related advantages.

SUMMARY OF THE INVENTION

The present invention is directed to a light fixture surface mount that provides a low-profile installation for light fixtures, as well as, multiple options for orientation and direction of the mounting surface. The light fixture surface mount has a base plate configured for attachment to a mounting surface, said base plate having a raised portion including a threaded opening therein. The surface mount also has a cover plate configured for overlaying the base plate, said cover plate having a raised portion and a non-threaded opening therein. The raised portion and non-threaded opening of the cover plate are configured for generally co-extensive alignment with the raised portion and threaded opening of the base plate. The surface mount also has a threaded stem configured for non-engaged passage through the non-threaded opening of the cover plate and threaded engagement with the threaded opening of the base plate.

The threaded stem includes an annular shoulder disposed between opposite ends thereof, said annular shoulder configured for abutting engagement with the raised portion of the cover plate around the non-threaded opening. Alternatively, the annular shoulder is configured for abutting engagement with the raised portion of the base plate around the threaded opening. In this alternative, the threaded stem is configured such that a light fixture mounted thereon will abuttingly engage the raised portion of the cover plate around the non-threaded opening.

The raised portion of the base plate is configured to overlay an electrical supply. The electrical supply may be a junction box disposed in the mounting surface, said junction box configured for the passage of electrical wires therethrough. Alternatively, the electrical supply comprises a port in the mounting surface, said port configured for the passage of electrical wires therethrough. The base plate may include a plurality of securing holes disposed therein, said securing holes configured for receiving fasteners to attach the base plate to the mounting surface.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
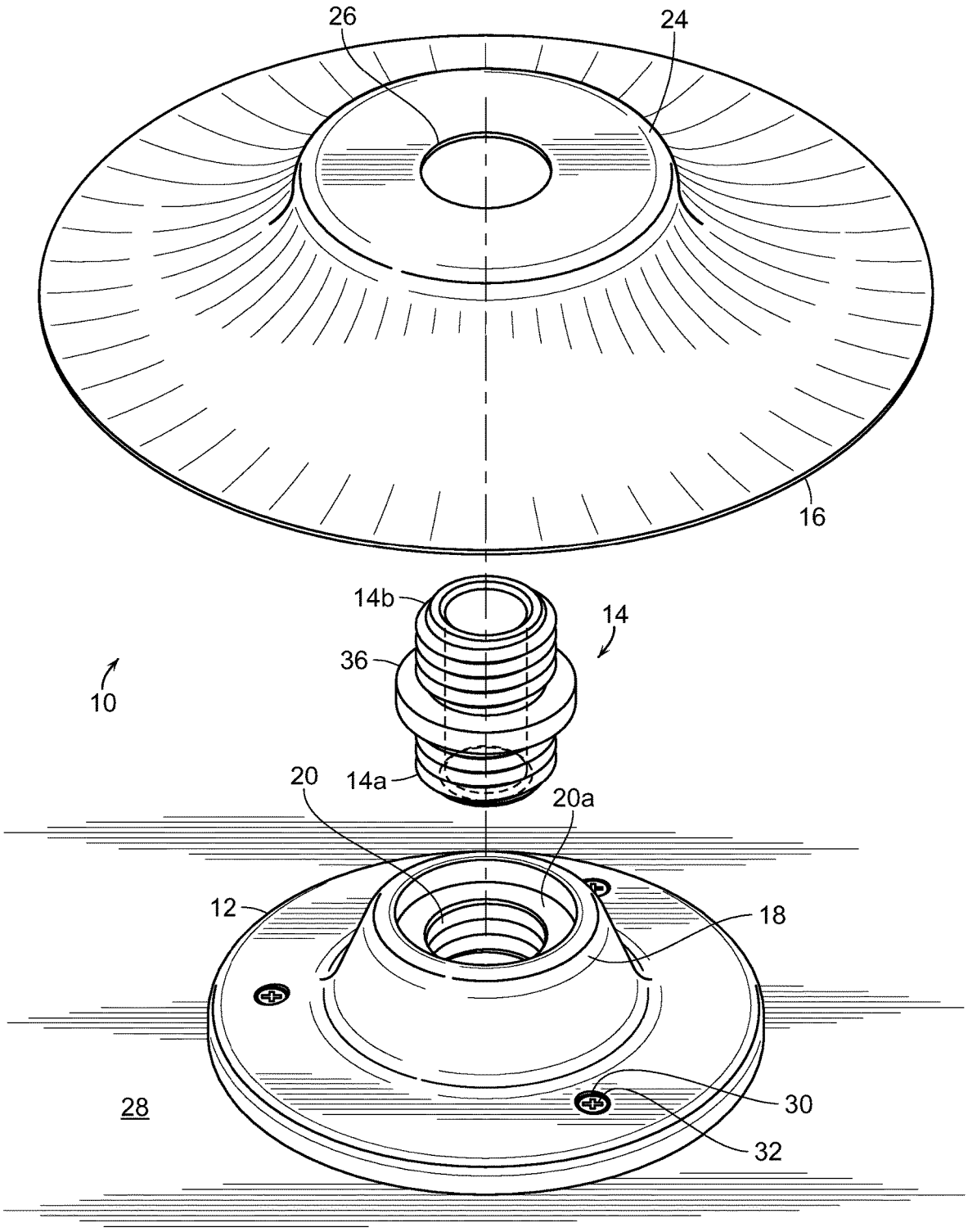
FIG. 1 is an exploded perspective view of an installation of the surface mount according to the present invention.
Figure 2:
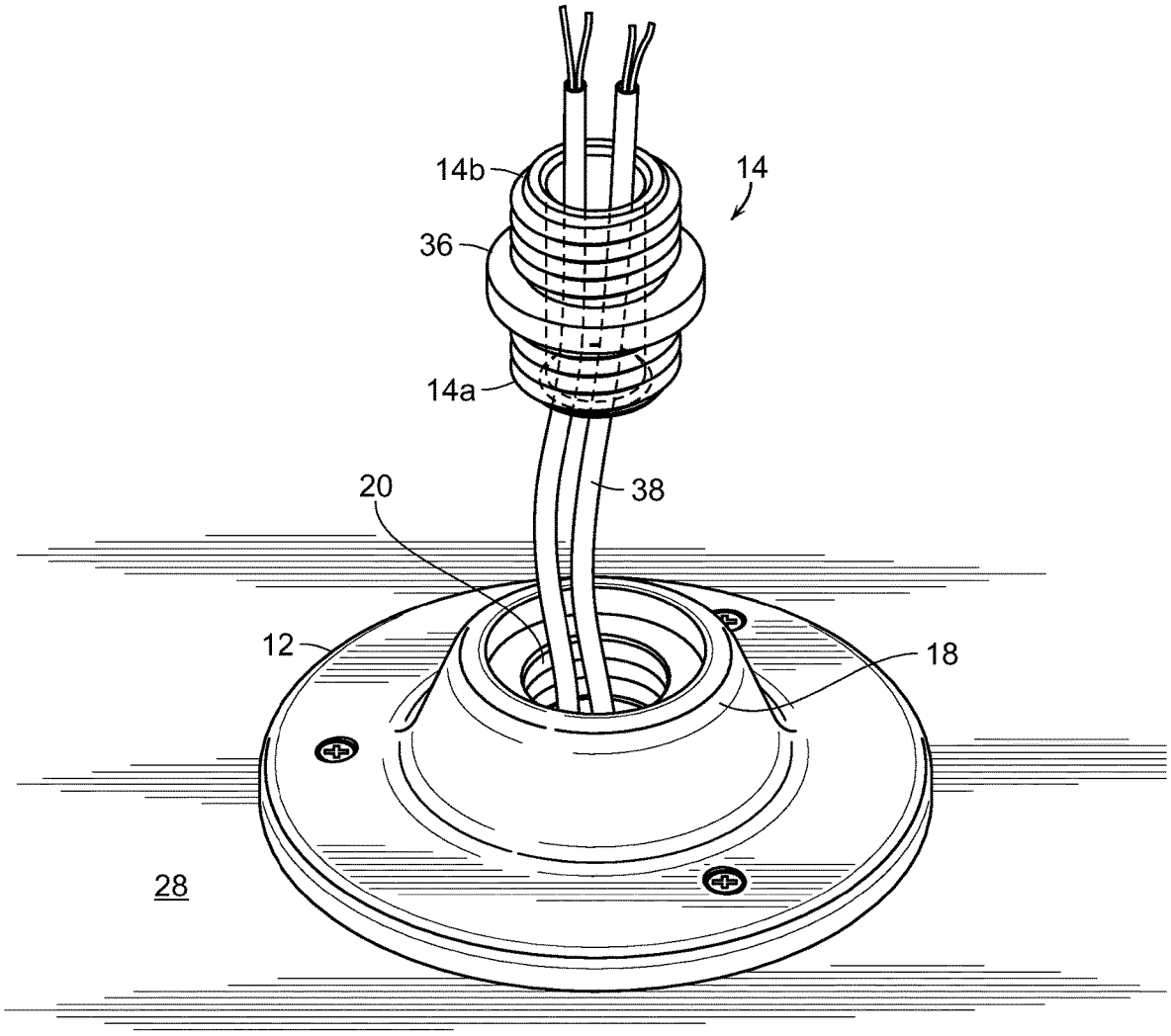
FIG. 2 is a partially exploded perspective view of the base plate and mounting stem of the surface mount according to the present invention.
Figure 3:
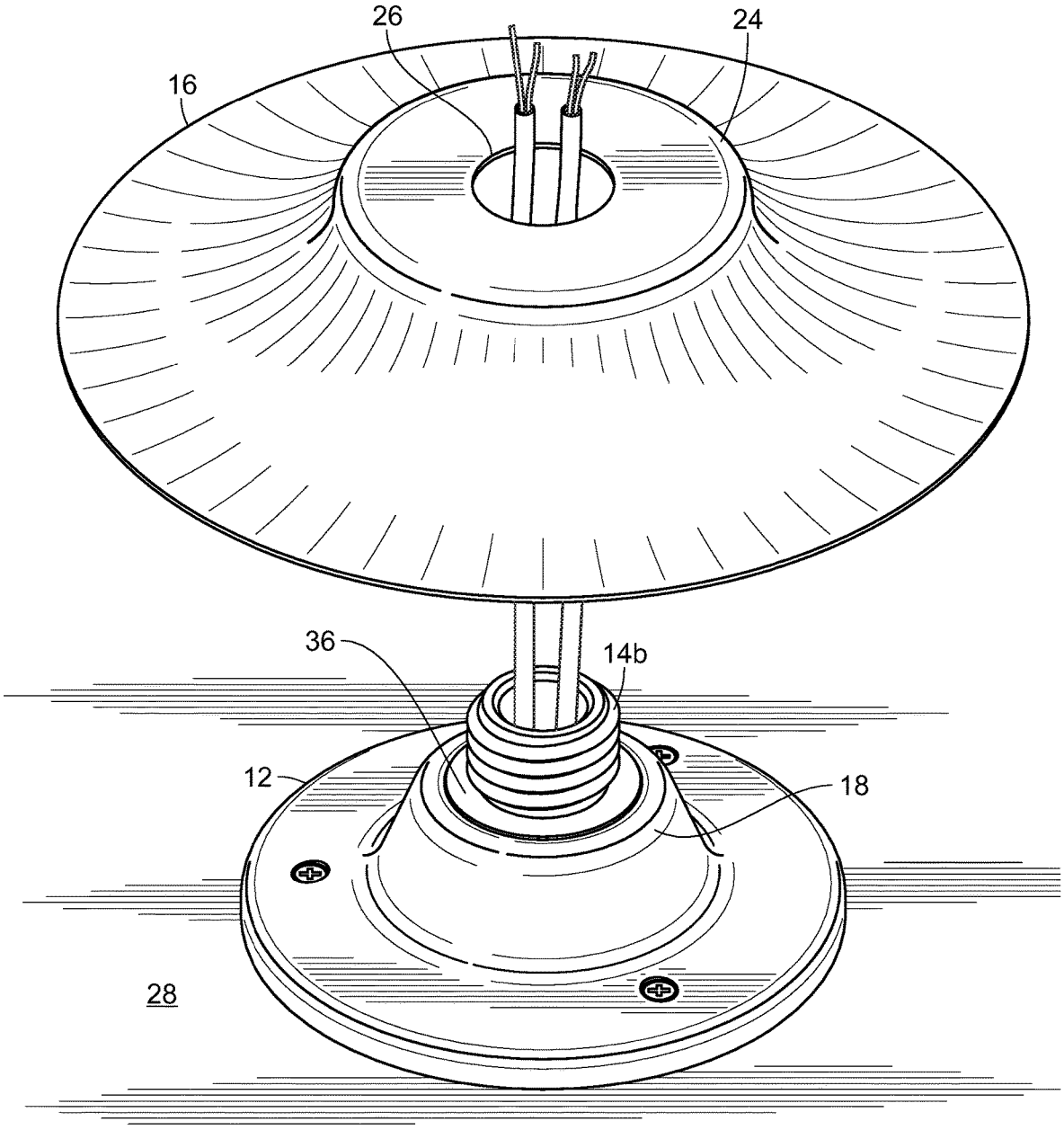
FIG. 3 is a partially exploded perspective view of the surface mount according to the present invention.
Figure 4:
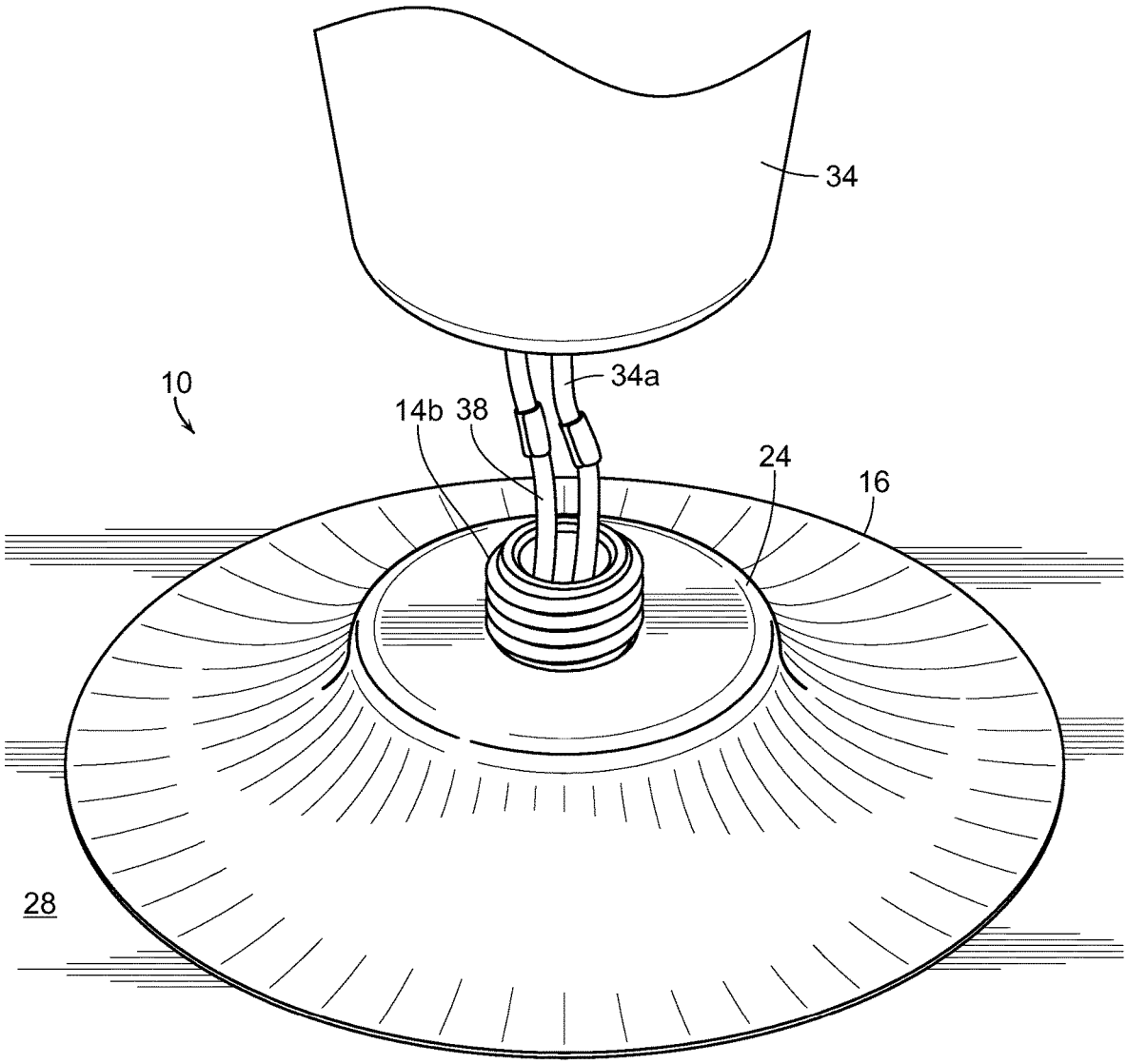
FIG. 4 is a partially exploded perspective view of the surface mount according to the present invention with a light fixture.
Figure 5:
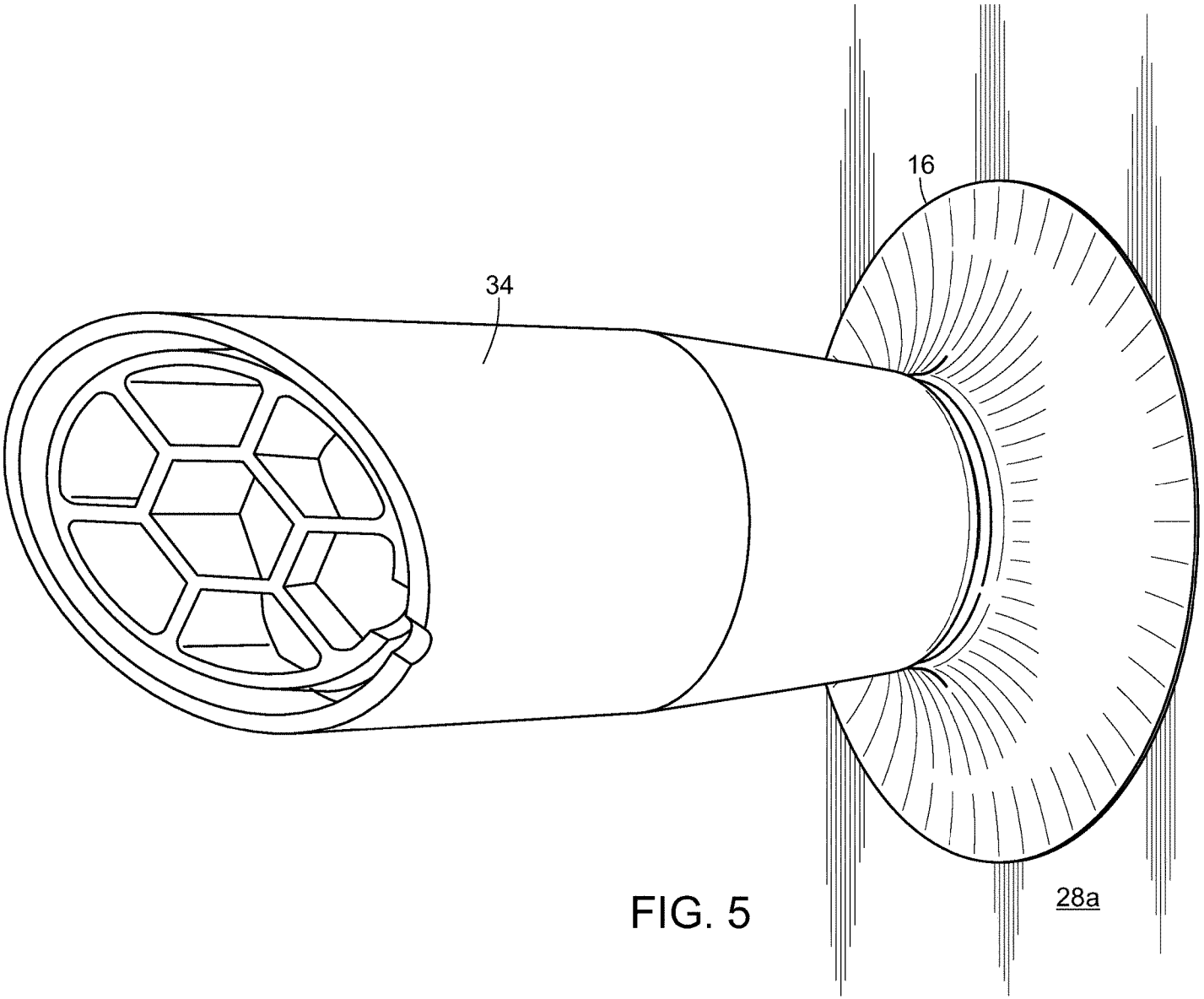
FIG. 5 is an environmental view of the surface mount according to the present invention with a light fixture.

The present invention is directed to light fixture surface mount for use in lighting installations. In the following detailed description, the inventive surface mount will be generally referred to by reference numeral 10. FIGS. 1-8 generally show the surface mount 10 from multiple angles and in multiple installations. The surface mount 10 is intended for use in lighting installations so as to facilitate the installation of lighting fixtures on interior and exterior surfaces such that the installation is low-profile, and the lighting fixture can be more easily oriented to illuminate desired areas.

As shown in FIGS. 1-5, the surface mount 10 generally consists of a base plate 12, a threaded mounting stem 14, and a cover plate 16. The base plate 12 is preferably generally circular in shape with a raised central portion 18 and a threaded opening 20 therein. The raised central portion 18 creates an open area 22 behind the base plate 12. While the preferred circular shape of the base plate 12 provides the most convenient installation and cosmetic appearance, the base plate 12 may formed in shapes other than circular.

The cover plate 16 is also preferably generally circular in shape with a raised central portion 24 and a non-threaded opening 26 therein. The raised central portion 24 of the cover plate preferably matches and is co-extensive with the raised central portion 18 of the base plate 12. In addition, the non-threaded opening 26 preferably aligns with the threaded opening 20 when the cover plate 16 is placed over the base plate 12. While the preferred shape of the cover plate 16 is circular mainly for cosmetic reasons, the cover plate 16 may come in other shapes that adequately cover the base plate 12 and cosmetically match the surrounding mounting surface 28.

The base plate 12 also includes a plurality of securing holes 30 annularly disposed around the edge of the base plate 12. The securing holes 30 are configured to receive fasteners 32 for attaching the base plate 12 to the mounting surface 28. The fasteners 32 may include screws, nails, or similar fasteners.

The threaded mounting stem 14 is preferably an elongated cylinder having a first threaded end 14*a* and a second threaded end 14*b*. The threads of the first end 14*a* are preferably configured to match the threads of the threaded opening 22 on the base plate 12. The threads of the second end 14*b* are preferably configured to match threads commonly found on mounts for light fixtures 34. The mounting stem 14 also includes an annular shoulder 36 disposed between the first and second ends 14*a*, 14*b*.

FIGS. 1-5 generally illustrate how the surface mount 12 is installed and/or assembled. The base plate 12 is attached to a mounting surface 28 by fasteners 32. The open area 22 behind the base plate 12 covers an electrical source consisting of, at a minimum, electrical wires 38 passed through a port 40 in the mounting surface 28. The first end 14*a* of the mounting stem 14 is threaded into the opening 20 in the central portion 18 of the base plate 12. The annular shoulder 36 of the mounting stem 14 is configured to abut against the raised central portion 18 of the base plate 12. Preferably, the raised central portion includes a recess 20*a* around the threaded opening 20 of the base plate 12. The annular should 36 is designed to fit snugly into the recess 20*a*.

The cover plate 16 fits over the base plate 12 and mounting stem 14 with the second end 14*b* protruding through the non-threaded opening 26 of the cover plate. The electrical wires 38 are passed through the mounting stem 14 and the non-threaded opening 26 and then connected to lead wires 34*a* on a light fixture 34. The light fixture 34 is then connected to the second end 14*b* of the mounting stem 14. When fully connected, the light fixture 34 abuts against the raised central portion 24 of the cover plate 16, securely holding the same against the base plate 12.

Figure 6:
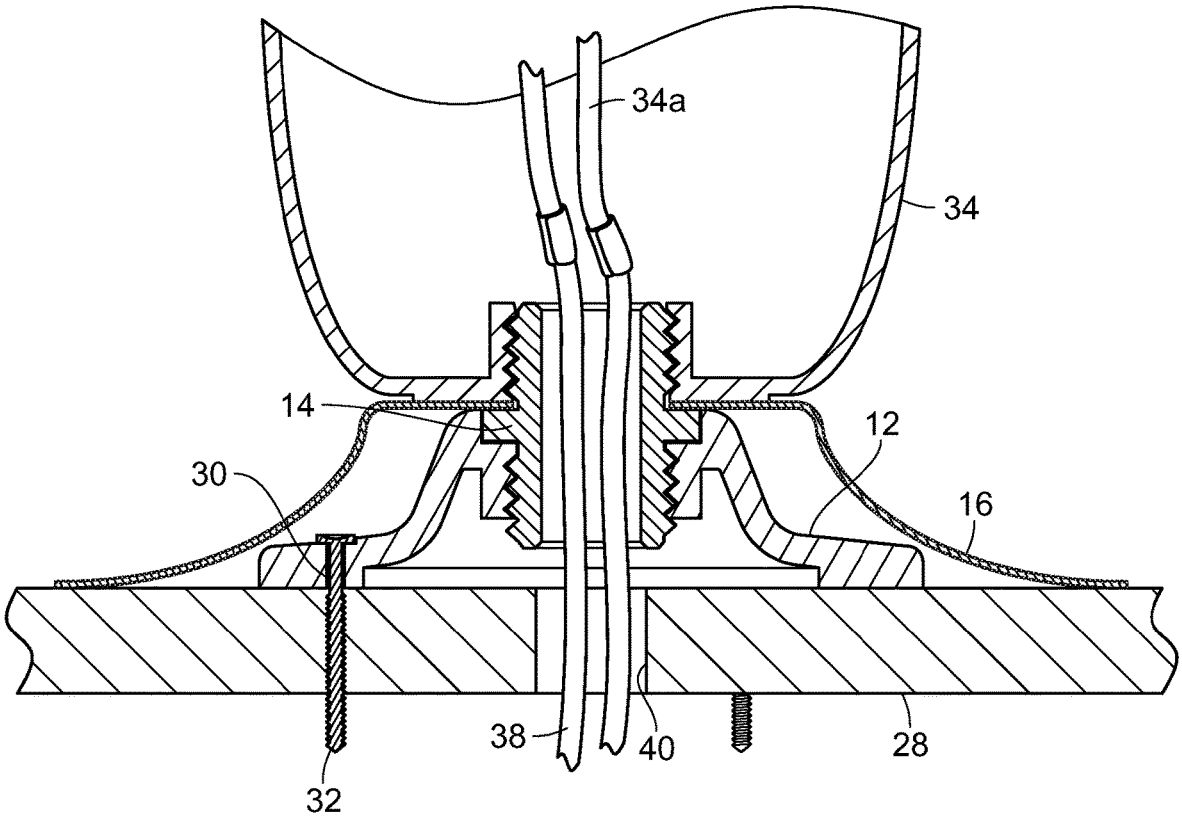
FIG. 6 is a cross-sectional view of the surface mount according to the present invention with an attached light fixture.
Figure 6A:
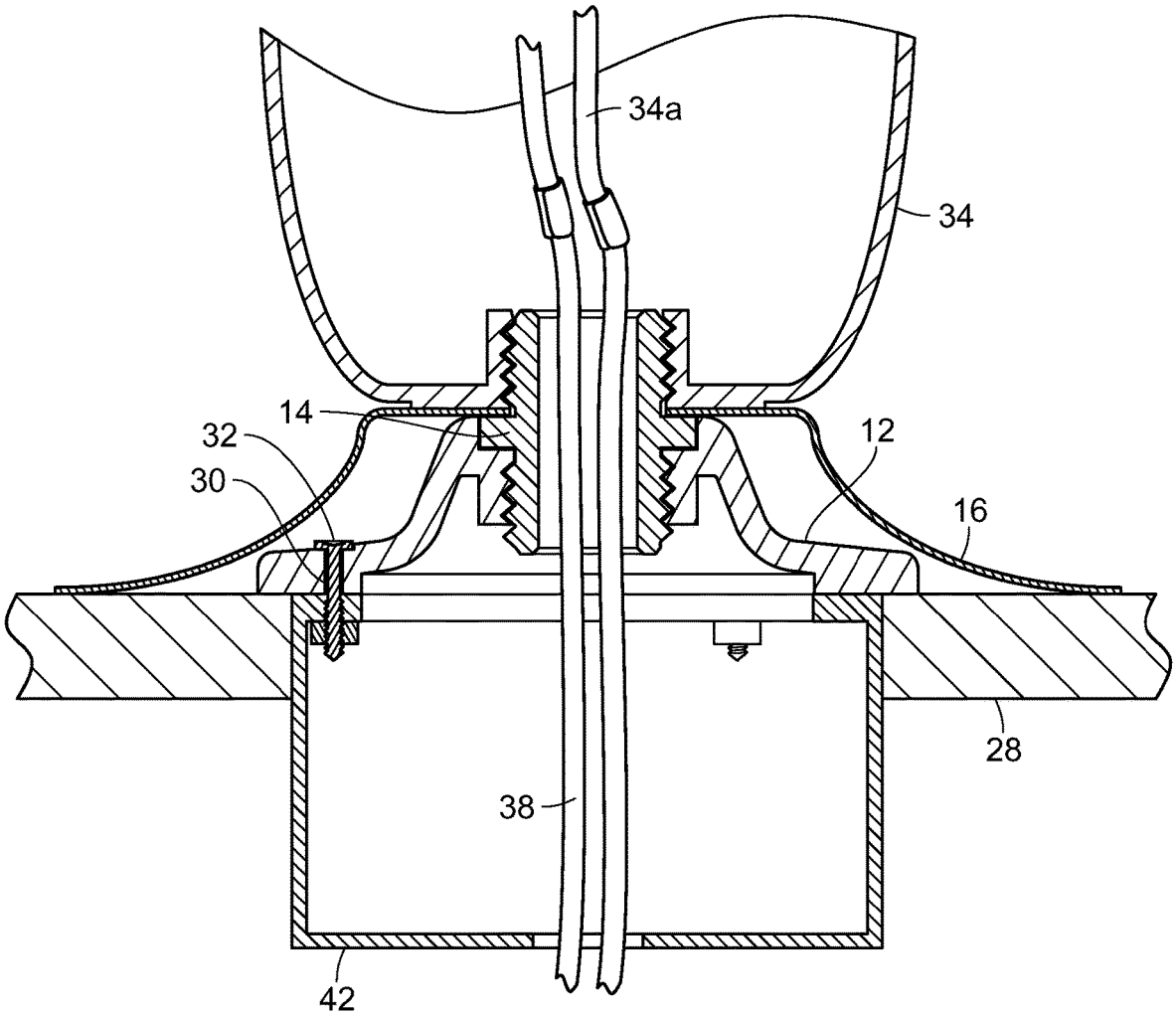
FIG. 6A is a cross-sectional view of an alternate installation of the surface mount according to the present invention with an attached light fixture.

FIG. 6 shows a cross-sectional view of the completed assembly. In an alternate embodiment, FIG. 6A shows the electrical source including wires 38 passing through an electrical junction box 42 mounted as is typically found in electrical installations. In such embodiment, the base plate 12 is attached to the junction box 42 by fasteners 32 as a prior art cover might be attached to a junction box 42.

Figure 6B:
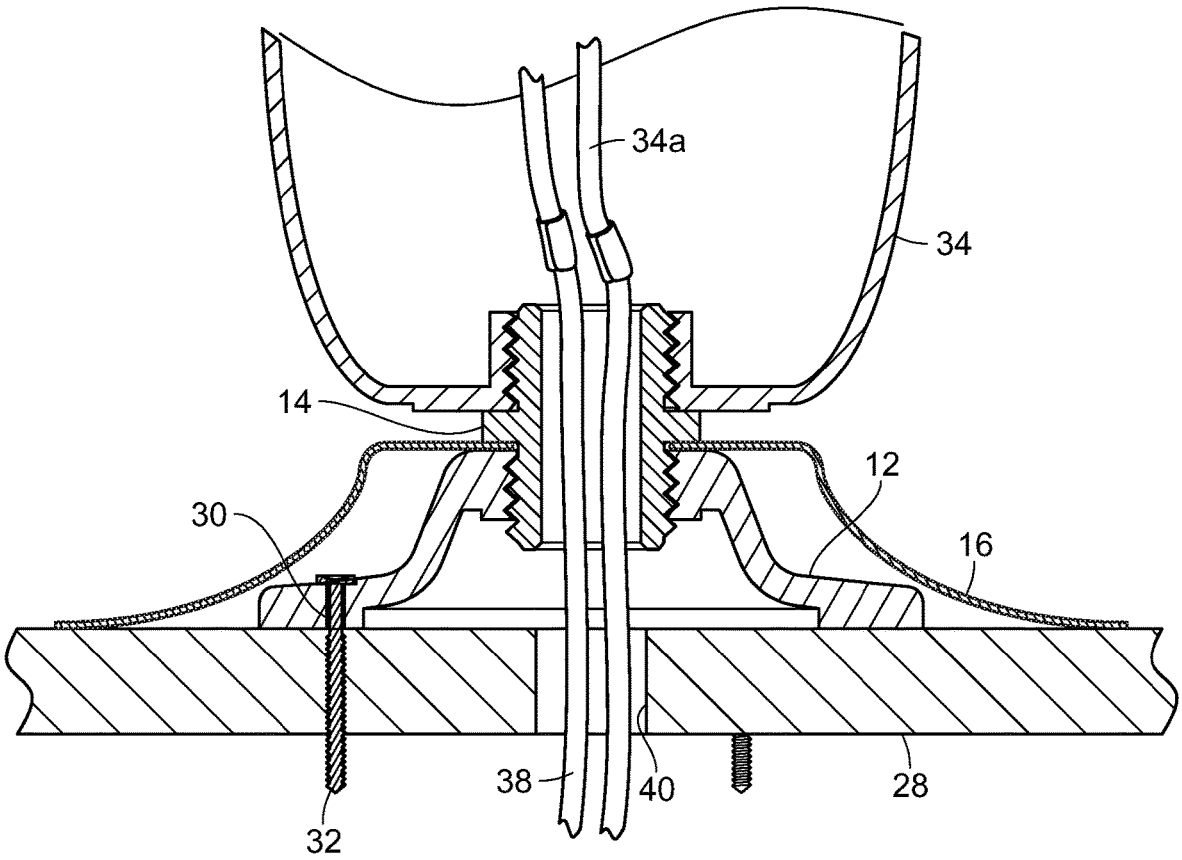
FIG. 6B is a cross-sectional view of another alternate embodiment of the surface mount according to the present invention with an attached light fixture.

In another alternate embodiment, FIG. 6B shows a base plate 12 that does not include a recess 20*a* around the threaded opening 20. In this configuration, the cover plate 16 may be disposed directly against the base plate 12. The first end 14*a* of the mounting stem 14 is attached to the threaded opening 20 such that the annular shoulder 36 abuts against the cover plate 16 around the non-threaded opening 26. Thus, the mounting stem 14 holds the cover plate 16 securely against the base plate 12. The light fixture 34 can then be electrically and mechanically connected as described above.

Figure 7:
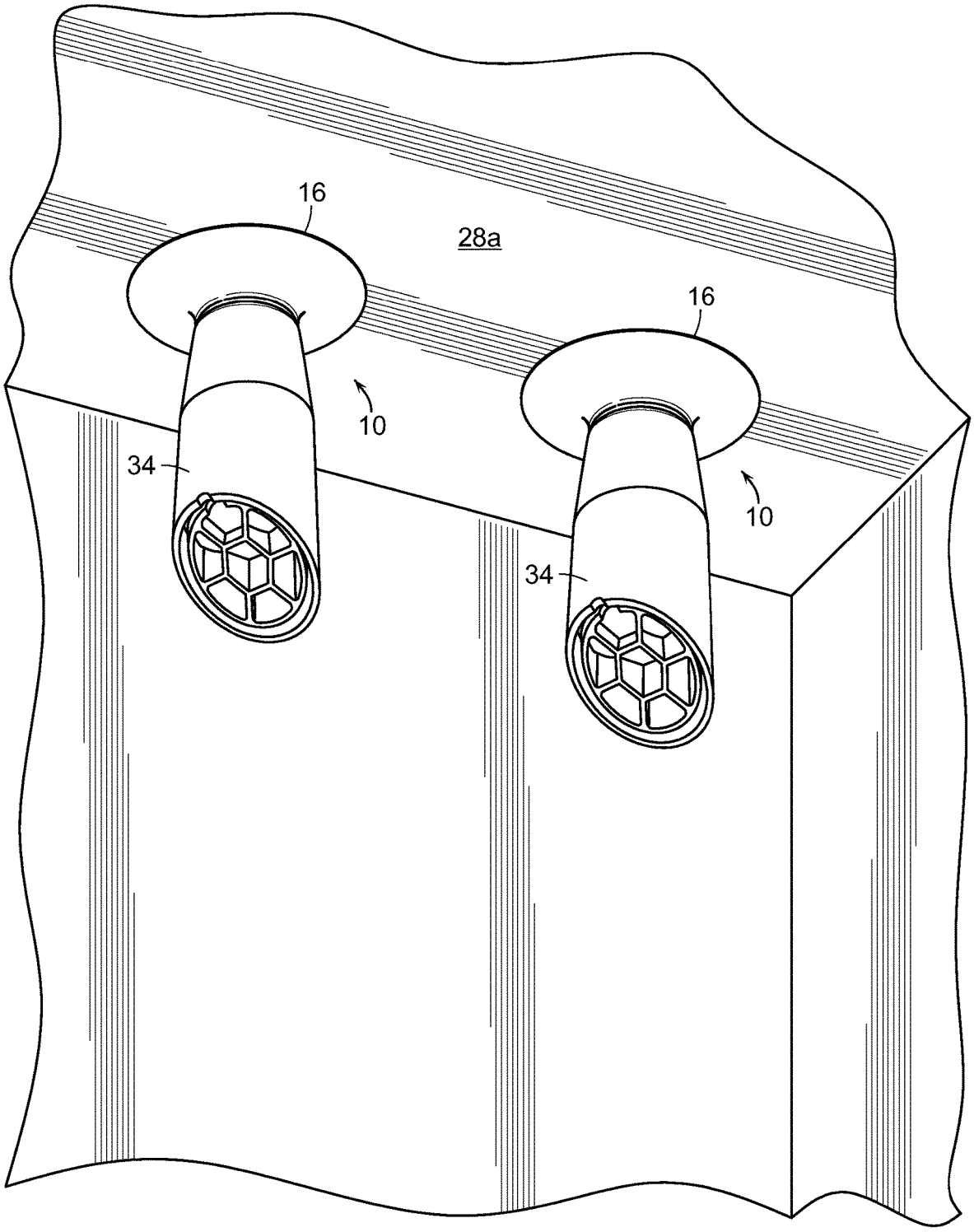
FIG. 7 is an environmental view of an interior installation of two surface mounts according to the present invention including connected light fixtures.
Figure 8:
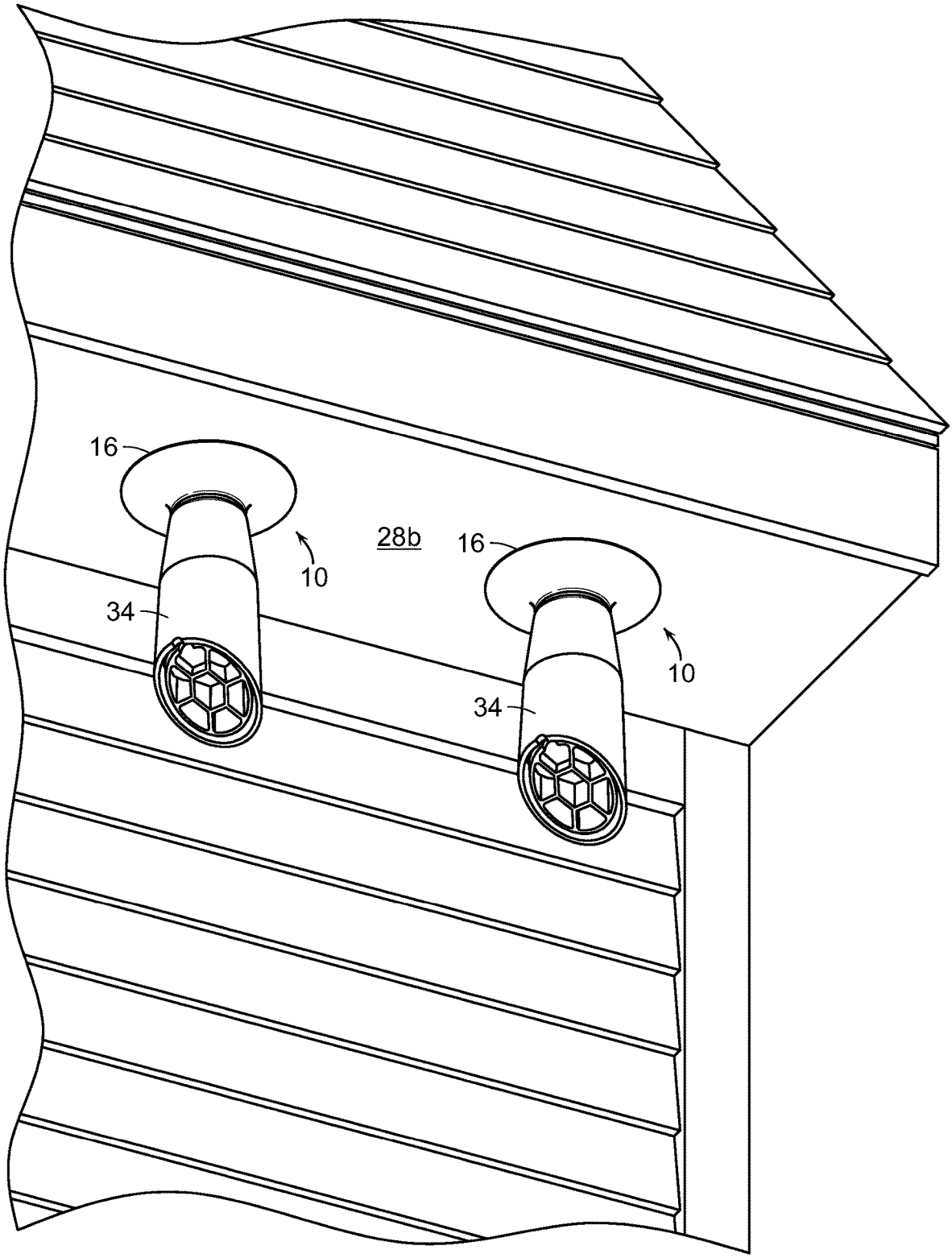
FIG. 8 is an environmental view of an exterior installation of two surface mounts according to the present invention including connected light fixtures.

FIG. 7 shows an environmental installation of two surface mounts 10 on an interior ceiling surface 28*a*. The inventive surface mount 10 facilitates installations of light fixtures on ceiling surfaces and other surface installations other than vertical walls. FIG. 8 shows a similar environmental installation of two surface mounts 10 on an exterior roof eave 28*b* or similar surface.

While the foregoing uses directional terms referring to the orientation of various mounting surfaces, a person of ordinary skill in the art will understand that those terms are only intended to indicate relative directions or orientations. The inventive surface mount 10 may be installed horizontally, vertically, on in any other directional orientation. Although several embodiments have been described in detail for purposes of illustration, various modifications may be made without departing from the scope and spirit of the invention.

What is claimed is:

1. A light fixture surface mount, comprising:

a base plate configured for attachment to a mounting surface, said base plate having a raised portion including a threaded opening therein;

a cover plate configured for overlaying the base plate, said cover plate having a raised portion and a non-threaded opening therein;

wherein the raised portion and non-threaded opening of the cover plate are configured for generally co-extensive alignment with the raised portion and threaded opening of the base plate;

a threaded stem configured for non-engaged passage through the non-threaded opening of the cover plate and threaded engagement with the threaded opening of the base plate wherein the threaded stem includes an annular shoulder disposed between opposite ends thereof, said annular shoulder configured for abutting engagement with the raised portion of the base plate around the threaded opening.

2. The light fixture surface mount of claim 1, wherein the raised portion of the base plate is configured to overlay an electrical supply.

3. The light fixture surface mount of claim 2, wherein the electrical supply comprises a junction box disposed in the mounting surface, said junction box configured for the passage of electrical wires therethrough.

4. The light fixture surface mount of claim 2, wherein the electrical supply comprises a port in the mounting surface, said port configured for the passage of electrical wires therethrough.

5. The light fixture surface mount of claim 1, further comprising a plurality of securing holes disposed in the base plate, said securing holes configured for receiving fasteners to attach the base plate to the mounting surface.

6. A light fixture surface mount, comprising:

a base plate configured for attachment to a mounting surface, said base plate having a raised portion including a threaded opening therein;

a cover plate configured for overlaying the base plate, said cover plate having a raised portion and a non-threaded opening therein;

wherein the raised portion and non-threaded opening of the cover plate are configured for generally co-extensive alignment with the raised portion and threaded opening of the base plate;

a threaded stem configured for non-engaged passage through the non-threaded opening of the cover plate and threaded engagement with the threaded opening of the base plate wherein the threaded stem includes an annular shoulder disposed between opposite ends thereof, said annular shoulder configured for abutting engagement with the raised portion of the base plate around the threaded opening;

wherein the threaded stem is configured such that a light fixture mounted thereon will abuttingly engage the raised portion of the cover plate around the non-threaded opening.

7. The light fixture surface mount of claim 6, wherein the raised portion of the base plate is configured to overlay an electrical supply.

8. The light fixture surface mount of claim 7, wherein the electrical supply comprises a junction box disposed in the mounting surface, said junction box configured for the passage of electrical wires therethrough.

9. The light fixture surface mount of claim 7, wherein the electrical supply comprises a port in the mounting surface, said port configured for the passage of electrical wires therethrough.

10. The light fixture surface mount of claim 6, further comprising a plurality of securing holes disposed in the base plate, said securing holes configured for receiving fasteners to attach the base plate to the mounting surface.

* * * * *